United States Patent [19]

Wold

[11] Patent Number: 4,987,941

[45] Date of Patent: Jan. 29, 1991

[54] DOOR REINFORCING DEVICE

[76] Inventor: Robert Wold, P.O. Box 184, Alliance, Alberta T0B 0A0, Canada

[21] Appl. No.: 254,246

[22] Filed: Oct. 6, 1988

[30] Foreign Application Priority Data

Jun. 2, 1988 [CA] Canada ..... 568499

[51] Int. Cl.[5] ..... E06B 3/48

[52] U.S. Cl. ..... 160/130; 160/201

[58] Field of Search ..... 160/130, 201; 248/354.1; 52/90

[56] References Cited

U.S. PATENT DOCUMENTS 2,966,212 12/1960 Fimbel, Jr. ..... 160/201

3,964,218 6/1976 Ho ..... 52/90

*Primary Examiner*—Blair M. Johnson

*Attorney, Agent, or Firm*—George A. Seaby

[57] ABSTRACT

Multi-sectional garage doors tend to bow downwardly in the middle because of the weight of the door. A simple solution to this problem is to provide a reinforcing device on the lowermost horizontal panel, the device including a pair of elongated bars for extending between the bottom center of the panel and the upper outer corners thereof, so that the load on the center of the door is transferred to the sides thereof to prevent sagging. The elongated bar is formed in sections interconnected end-to-end, one of the sections being a turnbuckle for adjusting the upward pull on the bottom of the door.

4 Claims, 2 Drawing Sheets

DOOR REINFORCING DEVICE

BACKGROUND OF THE INVENTION

1. Field of the Invention

This invention relates to a reinforcing device for a door, and in particular to a reinforcing device for use on multi-sectional garage doors.

2. Discussion of the Prior Art

Multi-sectional or sliding garage doors conventionally include a plurality of elongated horizontal oriented sections of wood or metal which are hingedly interconnected. Rollers or wheels are provided on the sides of the door for slidably mounting the door in parallel arcuate tracks, so that the door can readily be moved between the open and closed positions. A pair of large helical springs bias the door toward the open position so that the user is not required to lift the entire weight of the door in order to open the door. The combination of the weight of the door and the upward spring tension on the sides thereof may cause sagging of the centre of the door, and possible cracking thereof.

While reinforced doors have been proposed in the past, the reinforcement proposed for such doors cannot be used on modern multi-sectional garage doors. Examples of such doors or reinforcement for doors are disclosed by Canadian Pat. Nos. 186,374, issued to J. Little on Sept. 3, 1918; 192,002, issued to M.C. Blest on Aug. 5, 1919; 214,943, issued to H. Kaler on Jan. 3, 1922 and 517,184, issued to J.F. McKee et al on Oct. 4, 1955, and U.S. Pat. No. 2,804,953, issued to A.M. Buehler on Dec. 5, 1955.

The object of the present invention is to overcome the deficiencies of the prior art by providing a relatively simple, yet effective device for reinforcing a multi-sectional door.

GENERAL DESCRIPTION OF THE INVENTION

Accordingly, the present invention relates to a reinforcing device for use on a multi-sectional door of the type including a plurality of horizontal panels interconnected at each end to adjacent panels by hinges, said device comprising bar means for extending between the bottom centre of at least the lowermost door panel and the upper outer corners thereof, whereby the load on the door centre is transferred to the sides of the door to prevent sagging thereof.

BRIEF DESCRIPTION OF THE DRAWINGS

The invention will be described in greater detail with reference to the accompanying drawings, which illustrate a preferred embodiment of the invention, and wherein.

DESCRIPTION OF PREFERRED EMBODIMENTS

Figure 1:
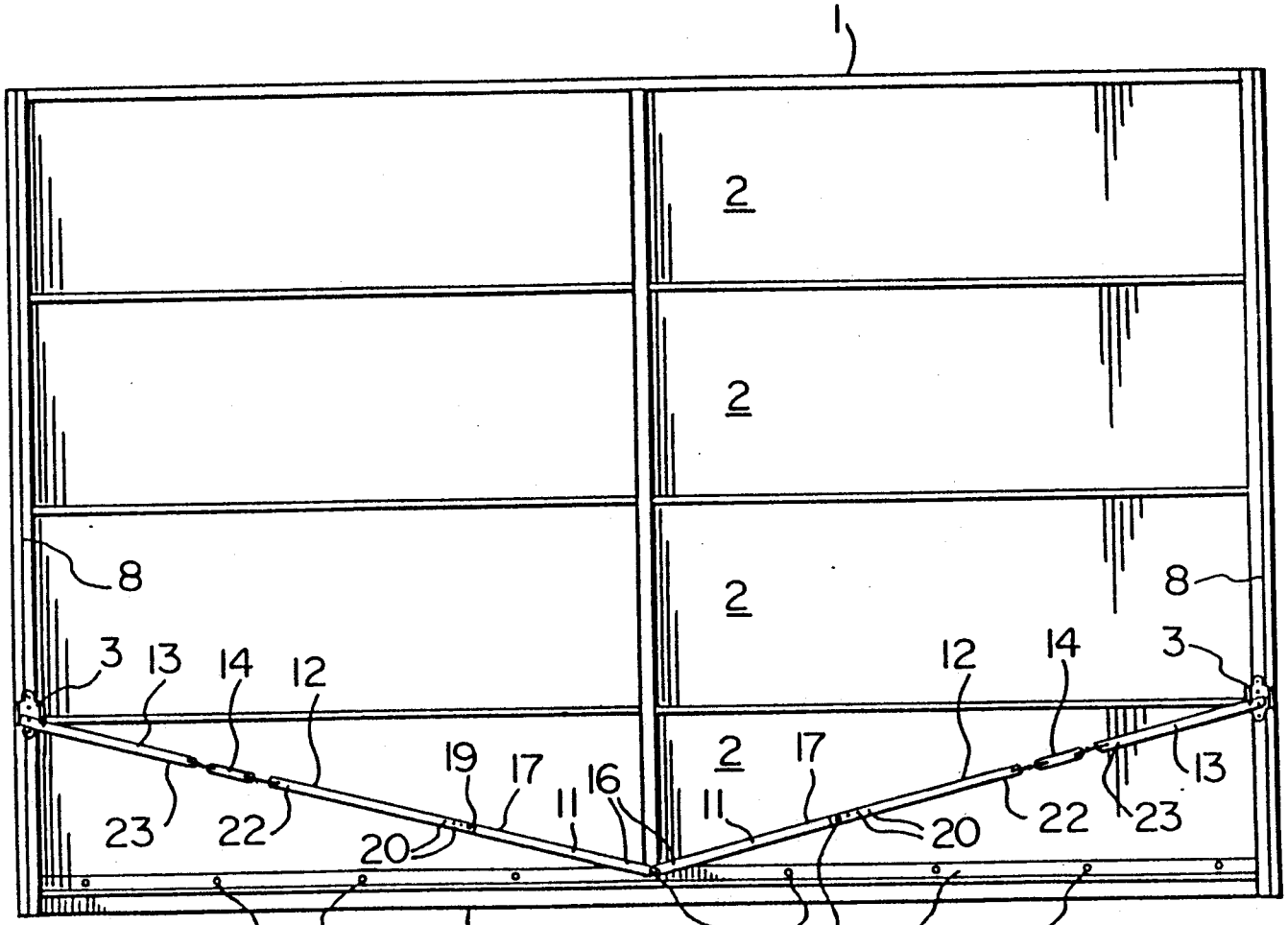
FIG. 1 is an elevational view of the inside of a garage door and a reinforcing device in accordance with the present invention.

Referring to the drawing, the preferred embodiment of the invention is intended for use on a multi-sectional garage door 1 of the type including a plurality of rectangular, horizontal panels 2 connected to each other by hinges 3 (two shown) along the length thereof. In this case, the expression "rectangular horizontal panels" is intended to mean rectangular panels, the longitudinal or major axes of which are located in horizontal planes. The bottom end 5 of the door is reinforced by a crossbar 6, which is usually an angle iron secured to the bottom door panel 2 by bolts 7, and the sides of the door are reinforced by strips 8, which carry the outermost hinges 9.

Figure 2:
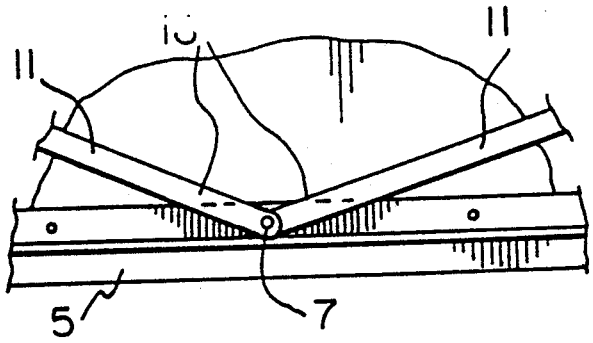
FIG. 2 is a front elevational view of the bottom centre portion of the device of FIG. 1 on a larger scale.

The reinforcing device of the present invention can be installed on new doors or be sold as a kit for installation on existing doors. The device is defined by three flat strips 11, 12 and 13 of metal, and a turnbuckle 14. As best shown in FIG. 2, the innermost end 16 of each strip 11 is connected to the bottom centre of the bottom panel 2 by removing the centre bolt 7, placing the flattened end 16 of the strips 11 in overlapping relationship over the bolt hole so that holes (not shown) in the strip are aligned with such bolt hole, and re-inserting the bolt. A hole (not shown) is provided in the outer end 17 of each strip 11 for receiving a bolt 19, which is also inserted through one of a plurality of axially aligned holes 20 in the inner end of the strip 12. The outer end 22 of the strip 12 is connected to the turnbuckle 14 using a small bolt, nut, and flat and lock washers (none shown), and the turnbuckle 14 is similarly connected to the inner end 23 of the outer strip 13.

Figure 3:
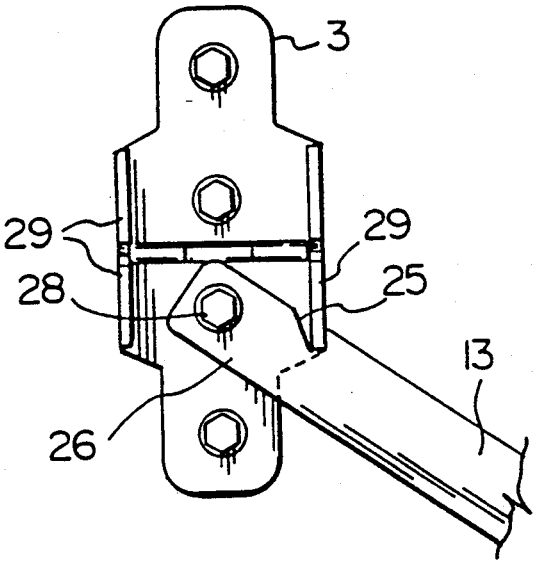
FIG. 3 is a front elevational view of a hinge and one end of the device of the present invention.

As best shown in FIG. 3, a notch 25 is provided in the outer end 26 of the strip 13 to facilitate the connecting of the latter to an outer door hinge 3. In order to connect the strip 13 to the hinge 3, one bolt 28 normally holding the hinge 3 on the door is removed, the end 26 of the strip is placed on the hinge 3 with the notch 25 receiving one of the hinge flanges 29, and the bolt 28 is re-inserted through aligned holes (not shown) in the strip 13 and the hinge 3 into the door.

Figure 4:
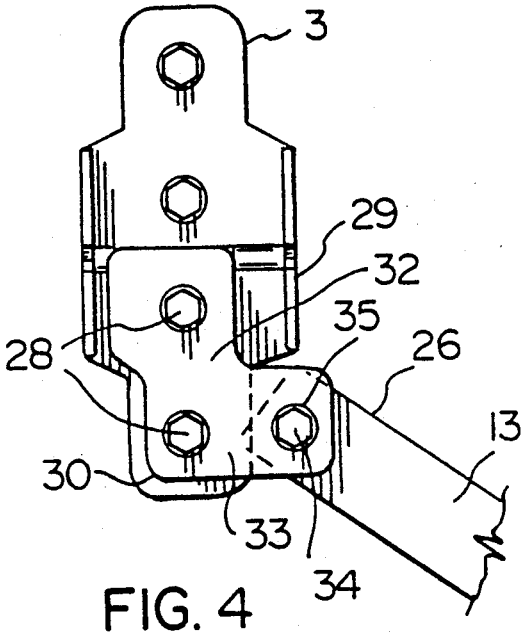
FIG. 4 is a front elevational view of a hinge and one end of a second embodiment of the invention.

In the second embodiment of the invention (FIG. 4), the notch 25 can be omitted form the outer end 26 of the strip 13, and an L-shaped bracket or connector 30 is provided for connecting the end 26 of the strip 13 to the hinge 3. Both lower hinge bolts 28 are removed and re-inserted through a vertical arm 32 of the connector 30. The horizontal arm 33 of the connector 30 extends inwardly beneath the flange 29 of the hinge 3, and is connected to the outer end 26 of the strip 13 by a bolt 34, washers 35 (one shown) and a nut (not shown). This embodiment of the invention is actually intended for use when the notch 25 does not fit over the hinge flange 29.

Typical installation instructions for the device could read as follows:

1. Remove the top nut and bolt 28 from the bottom half of the hinge 3.

2. Place the outer end 26 of the strip 13 on the hinge 3 so that the holes in the hinge and in the strip 13 are aligned. If the notch 25 does not permit such alignment, remove the other nut and bolt 28 from the bottom half of the hinge, attach the outer end 26 of the strip 13 to the horizontal arm 33 of the connector 30 and connect the latter to the hinge using the hinge bolts 28.

3. Connect one end of the turnbuckle 14 to the inner, free end 23 of the strip 13 using the ¼" bolt, nut, and flat and lock washers provided in the kit.

4. Connect the other end of the turnbuckle to the outer end 22 of the strip 12 using the ¼" bolt, nut and flat and lock washers provided in the kit.

5. Repeat steps (1) and (4) on the other side of the door interior.

6. Fasten the inner ends 16 of strips 11 to the crossbar 6 using the middle door bolt 7. If a lag screw is used at the door centre, replace the lag screw with the longer lag screw provided in the kit. If not hole is present at the door centre, it will be necessary to drill a 3/8" or 11/64"× 1" deep pilot hole into the vertical arm of the crossbar 6.

7. With the turnbuckles 14 fully extended, connect the inner ends of the strips 12 to the outer end of the strips 11 using the bolts, nuts and lock washers provided in the kit.

8. Hand tighten the turnbuckles 14, and retighten all nuts and bolts.

9. Check the cement on the bottom of the door to determine whether the cement is level, and whether settling at the edges has occurred.

10. Raise the door and place a 2" block beneath the centre of the door. Lower the door onto the block and tighten the turnbuckle 14 until the door is straight. Remove the block.

11. Raise and lower the door three or four times. If the door is not flush with the floor, repeat step (10).

12. In severe cases, the above steps may have to be repeated after a delay of three to four weeks.

In some cases, it may be necessary to drill a hole through the lower end of the bottom panel 2 of the door to accommodate a bolt for connecting the two flat irons at the base of the door. The bolt would replace a central lag screw 7 on the door.

Another embodiment of the invention includes all of the elements of the device of FIGS. 1 to 3, with the exception of the notch 25 in the strip 13. With or without the notch 25, it has been found that the outer, top end of the strip 13 can be inserted beneath the bottom portion of the hinge, i.e. the bolts 28 can be removed, the strip 13 inserted beneath the bottom arm of the hinge, and the bolts 28 reinserted.

It will be appreciated that a reinforcing device of the type described above can be mounted on the lowermost horizontal door panel only, or alternatively similar devices can be mounted on a plurality of the horizontal panels.

I claim:

1. In combination, a multi-sectional door of the type including a plurality of horizontal panels interconnected at each end to adjacent panels by hinges, and a reinforcing device for said door, said device comprising two first bar means; two first flat connector means; notch means in said two first connector means, whereby said first connector means connect one end of each of said first bar means to respective hinges on each side of the door; two second bar means; two second connector means connecting one end of each said second bar means to the bottom center of the door panel; and turnbuckle means interconnecting the other ends of said first and second bar means, whereby the first and second bar means and the turnbuckle means extend between the bottom center of at least the lowermost door panel and the upper outer corners thereof to transfer the load on the door center to both sides of the door to prevent sagging thereof.

2. Apparatus according to claim 1, wherein each said first connector means is integral with and defines said one end of one of said first bar means.

3. Apparatus according to claim 1, wherein each said first connector means includes L-shaped plate means, the arms of said plate means defining said notch means, one arm of the plate means being adapted for mounting on a door hinge, and the other arm thereof being connected to said one end of a first bar means.

4. Apparatus according to claim 3, wherein said first and second bar means include three flat strips of metal, said turnbuckle means interconnecting one end of the middle strip in end-to-end relationship to one end of one strip; and both means extending through the other end of the middle strip and the other end strip for adjustable connecting said middle strip to the other end strip.

* * * * *